US011005237B2

(12) United States Patent
Nakano et al.

(10) Patent No.: US 11,005,237 B2
(45) Date of Patent: May 11, 2021

(54) IGNITION PLUG

(71) Applicant: NGK SPARK PLUG CO., LTD., Nagoya (JP)

(72) Inventors: Seiji Nakano, Nagoya (JP); Kengo Fujimura, Nagoya (JP); Shoma Tsumagari, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 16/902,321

(22) Filed: Jun. 16, 2020

(65) Prior Publication Data

US 2020/0403386 A1 Dec. 24, 2020

(30) Foreign Application Priority Data

Jun. 18, 2019 (JP) ..... JP2019-112896

(51) Int. Cl.
*H01T 13/34* (2006.01)

(52) U.S. Cl.
CPC ..... *H01T 13/34* (2013.01)

(58) Field of Classification Search
USPC ..... 123/169 EL
See application file for complete search history.

(56) References Cited

U.S. PATENT DOCUMENTS

2002/0115549 A1* 8/2002 Geier ..... H01T 13/34 501/5
2005/0242694 A1* 11/2005 Honda ..... H01T 13/34 313/118
2006/0158081 A1* 7/2006 Shibata ..... H01T 13/34 313/118
2007/0290590 A1 12/2007 Hoffman
2012/0176021 A1* 7/2012 Yoshida ..... C03C 8/02 313/141
2016/0226224 A1* 8/2016 Zheng ..... H01T 13/20

FOREIGN PATENT DOCUMENTS

JP 2005-340171 A 12/2005
JP 2007-179788 A 7/2007
JP 2009-545860 A 12/2009

* cited by examiner

*Primary Examiner* — Ashok Patel
(74) *Attorney, Agent, or Firm* — Kusner & Jaffe

(57) ABSTRACT

An ignition plug comprising: an insulator having a through hole extending from a rear-end side toward a forward-end side; a center electrode inserted at least partially into a portion of the through hole on the forward-end side; a metal terminal member inserted at least partially into a portion of the through hole on the rear-end side; and a seal disposed within the through hole and in contact with the center electrode and an inner circumferential surface of the insulator. The seal contains a glass and an electrically conductive substance, and the glass contained in the seal contains Si in an amount of 50 mass % or more as reduced to $SiO_2$ and Na in an amount of 0.1 mass % or more and less than 1 mass % as reduced to $Na_2O$.

4 Claims, 3 Drawing Sheets

FIG. 2A

| No. | 1 | 2 | 3 | 4 | 5 | 6 |
|---|---|---|---|---|---|---|
| K($K_2O$) (wt%) | 2 | 2 | 2 | 2 | 2 | 2 |
| Na($Na_2O$) (wt%) | 0 | 0.1 | 0.3 | 0.4 | 0.9 | 1 |
| WITHSTAND VOLTAGE | A | A | A | B | B | C |
| DENSIFICATION | B | A | A | A | A | A |

TA

FIG. 2B

| No. | 7 | 8 | 9 | 10 |
|---|---|---|---|---|
| K($K_2O$) (wt%) | 1 | 4 | 8 | 10 |
| Na($Na_2O$) (wt%) | 0.2 | 0.2 | 0.2 | 0.2 |
| WITHSTAND VOLTAGE | A | A | A | A |
| DENSIFICATION | A | A | A | A |
| AIRTIGHTNESS | A | A | B | C |

TB

IGNITION PLUG

FIELD OF THE INVENTION

The present invention relates to an ignition plug.

BACKGROUND OF THE INVENTION

Conventionally, an ignition plug is used to ignite fuel in an apparatus in which fuel is burned (e.g., an internal combustion engine). The ignition plug includes, for example, an insulator having a through hole, a center electrode inserted at least partially into a portion of the through hole on the forward-end side, a metal terminal member inserted at least partially into a portion of the through hole on the rear-end side, and a seal disposed within the through hole and in contact with the center electrode and an inner circumferential surface of the insulator. The seal contains, for example, glass. Prior art includes Japanese Patent Application Laid-Open (kokai) No. 2005-340171; Japanese Kohyo (PCT) Patent Publication No. 2009-545860; and Japanese Patent Application Laid-Open (kokai) No. 2007-179788.

In the case where the $SiO_2$ content of glass is high, since the thermal expansion coefficient of the glass lowers, the heat resistance performance of the seal improves. However, in this case, the glass becomes hard. In the case where the glass further contains sodium (Na), since the softening point of the glass drops, an appropriate seal can be formed. However, in some cases, as a result of diffusion of Na from the seal to the insulator, the voltage resistance performance of the insulator deteriorates.

SUMMARY OF THE INVENTION

The present specification discloses a technique capable of restraining deterioration in the voltage resistance performance of an insulator of an ignition plug having a seal that contains a glass.

Means for Solving the Problem

The technique disclosed in the present specification can be implemented as the following application examples.

Application Example 1

An ignition plug comprising: an insulator having a through hole extending from a rear-end side toward a forward-end side; a center electrode inserted at least partially into a portion of the through hole on the forward-end side; a metal terminal member inserted at least partially into a portion of the through hole on the rear-end side; and a seal disposed within the through hole and in contact with the center electrode and an inner circumferential surface of the insulator, wherein the seal contains a glass and an electrically conductive substance, and the glass contained in the seal contains Si in an amount of 50 mass % or more as reduced to $SiO_2$ and Na in an amount of 0.1 mass % or more and less than 1 mass % as reduced to $Na_2O$.

According to the present configuration, since the seal in contact with the inner circumferential surface of the insulator and with the center electrode contains a glass, and the glass contains Si in an amount of 50 mass % or more as reduced to $SiO_2$, the seal can have improved heat resistance performance. Also, since the glass contains Na in an amount of 0.1 mass % or more and less than 1 mass % as reduced to $Na_2O$, an appropriate seal can be manufactured, the diffusion of Na to the insulator is restrained, and deterioration in the voltage resistance performance of the insulator can be restrained.

Application Example 2

An ignition plug comprising: an insulator having a through hole extending from a rear-end side toward a forward-end side; a center electrode inserted at least partially into a portion of the through hole on the forward-end side; a metal terminal member inserted at least partially into a portion of the through hole on the rear-end side; and a seal disposed within the through hole and in contact with the center electrode and an inner circumferential surface of the insulator, wherein the seal contains a glass and an electrically conductive substance, the glass contained in the seal contains Si in an amount of 50 mass % or more as reduced to $SiO_2$ and Na in an amount of 0.1 mass % or more and less than 1 mass % as reduced to $Na_2O$, and the glass contains Na in an amount of 0.3 mass % or less as reduced to $Na_2O$.

According to the present configuration, deterioration in voltage resistance performance of the insulator can be further restrained.

Application Example 3

An ignition plug comprising: an insulator having a through hole extending from a rear-end side toward a forward-end side; a center electrode inserted at least partially into a portion of the through hole on the forward-end side; a metal terminal member inserted at least partially into a portion of the through hole on the rear-end side; and a seal disposed within the through hole and in contact with the center electrode and an inner circumferential surface of the insulator, wherein the seal contains a glass and an electrically conductive substance, the glass contained in the seal contains Si in an amount of 50 mass % or more as reduced to $SiO_2$ and Na in an amount of 0.1 mass % or more and less than 1 mass % as reduced to $Na_2O$, and the glass contains K in an amount of 1 mass % to 8 mass % as reduced to $K_2O$.

According to the present configuration, since contained potassium (K) lowers the softening point of the glass, an appropriate seal can be formed.

The technique disclosed in the present specification can be implemented in various forms; for example, an ignition plug, an ignition apparatus using the ignition plug, an internal combustion engine having the ignition plug, and an internal combustion engine carrying the ignition apparatus using the ignition plug.

BRIEF DESCRIPTION OF THE DRAWINGS

FIG. 2A is a table TA showing the relation between test results and material features of samples of the ignition plug; and FIG. 2B is a table TB showing the relation between test results and material features of samples of the ignition plug;

DETAILED DESCRIPTION OF THE INVENTION

A. Embodiment

Figure 1:
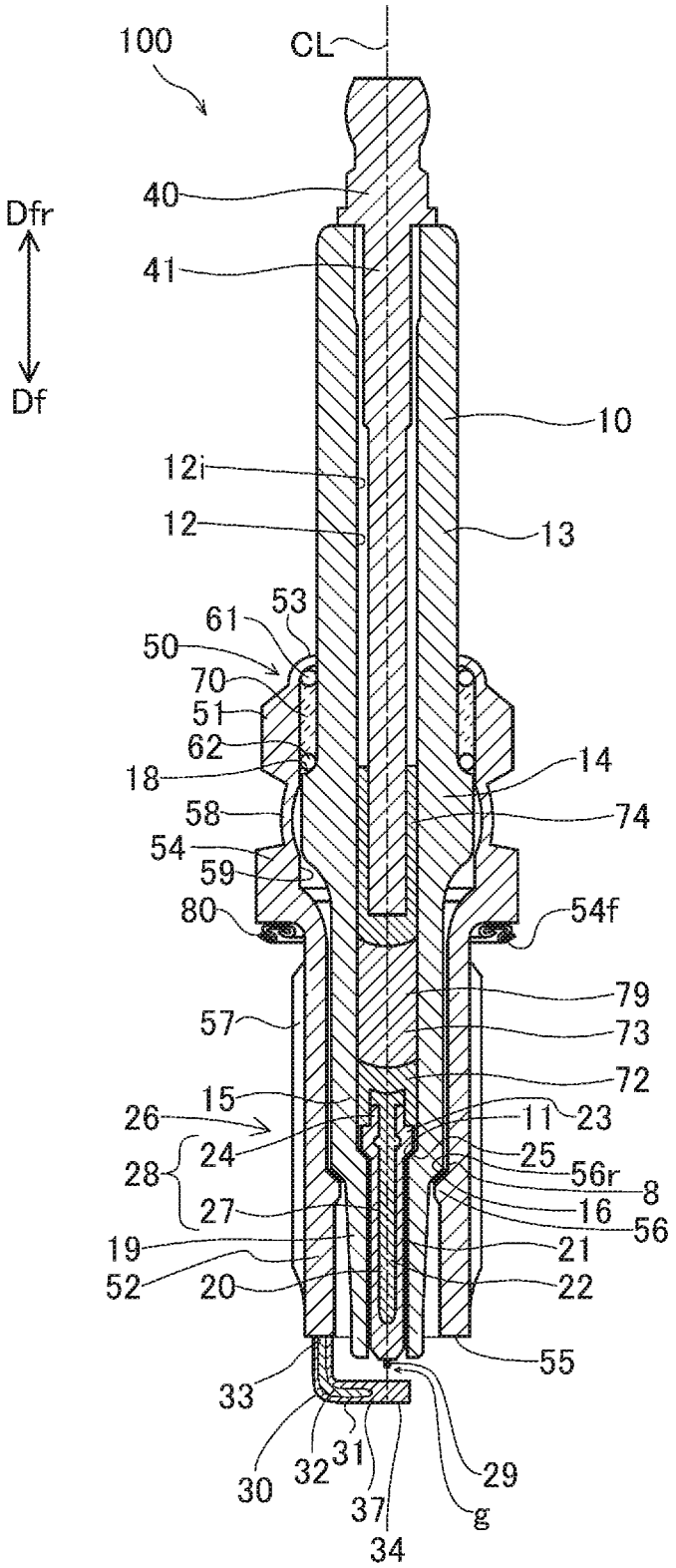
FIG. 1 is a sectional view of an ignition plug 100 according to an embodiment of the present invention.

FIG. 1 is a sectional view of an ignition plug 100 according to an embodiment of the present invention. The drawing illustrates a center axis CL (also called "axial line CL") of the ignition plug 100, and a flat cross section of the ignition plug 100 which contains the center axis CL. Hereinafter, a direction in parallel with the center axis CL is called the "direction of the axial line CL" and is also called merely the "axial direction." A radial direction of a circle centered on the axial line CL is also be called a "radial direction." The radial direction is a direction perpendicular to the axial line CL. A circumferential direction of the circle centered on the axial line CL is also called a "circumferential direction." Regarding the direction in parallel with the center axis CL, the downward direction in FIG. 1 is called a forward-end direction Df or a forward direction Df, and the upward direction is called a rear-end direction Dfr or a rearward direction Dfr. The forward-end direction Df is directed from a metal terminal member 40 toward a center electrode 20, these members being described later. A forward-end direction Df side in FIG. 1 is called a forward-end side of the ignition plug 100, and a rear-end direction Dfr side in FIG. 1 is called a rear-end side of the ignition plug 100.

The ignition plug 100 has a tubular insulator 10 having a through hole 12 (may also be called an axial hole 12) extending from the rearward direction Dfr side toward the forward direction Df side, a center electrode 20 held in the through hole 12 on the forward-end side, a metal terminal member 40 held in the through hole 12 on the rear-end side, an intermediate member 79 disposed within the through hole 12 between the center electrode 20 and the metal terminal member 40, an electrically conductive first seal 72 which is in contact with the intermediate member 79 and the center electrode 20 and electrically connects the intermediate member 79 and the center electrode 20, an electrically conductive second seal 74 which is in contact with the intermediate member 79 and the metal terminal member 40 and electrically connects the intermediate member 79 and the metal terminal member 40, a tubular metallic shell 50 fixed to the outer circumference of the insulator 10, and a ground electrode 30 whose one end is joined to an annular forward end surface 55 of the metallic shell 50 and whose other end faces the center electrode 20 with a discharge gap g formed therebetween. In the present embodiment, the intermediate member 79 is composed of a resistor element 73.

The insulator 10 is a tubular member extending along the axial line CL. The insulator 10 has a large-diameter portion 14 having the largest outside diameter and formed at a central portion thereof. A rear-end-side trunk portion 13 smaller in outside diameter than the large-diameter portion 14 is connected to an end of the large-diameter portion 14 on the rearward direction Dfr side. At a connection portion 18 between the large-diameter portion 14 and the rear-end-side trunk portion 13, the outside diameter of the insulator 10 reduces gradually in the rearward direction Dfr (the connection portion 18 is also called an outside-diameter-reducing portion 18).

The insulator 10 has a forward-end-side trunk portion 15 smaller in outside diameter than the large-diameter portion 14 and connected to an end of the large-diameter portion 14 on the forward direction Df side. A leg portion 19 smaller in outside diameter than the forward-end-side trunk portion 15 is connected to an end of the forward-end-side trunk portion 15 on the forward direction Df side. The leg portion 19 includes the forward end of the insulator 10. At a connection portion 16 between the forward-end-side trunk portion 15 and the leg portion 19, the outside diameter of the insulator 10 reduces gradually in the forward direction Df (the connection portion 16 is also called an outside-diameter-reducing portion 16 or a step portion 16). The forward-end-side trunk portion 15 has an inside-diameter-reducing portion 11 formed therein. The inside diameter of the inside-diameter-reducing portion 11 reduces gradually in the forward direction Df.

Preferably, the insulator 10 is formed in consideration of mechanical strength, thermal strength, and electrical strength. The insulator 10 is formed, for example, by firing alumina (other electrically insulating materials can be employed).

The center electrode 20 is a rodlike metal member extending along the axial line CL. A portion of the center electrode 20 on the rear-end direction Dfr side is inserted into a portion of the through hole 12 of the insulator 10 on the forward direction Df side. The center electrode 20 has a rod portion 28, and a first tip 29 joined (by, for example, laser welding) to the forward end of the rod portion 28. The rod portion 28 has a head portion 24 on the rearward direction Dfr side, and a shaft portion 27 connected to an end of the head portion 24 on the forward direction Df side. The shaft portion 27 has an approximately circular columnar shape extending in the forward direction Df. The head portion 24 has a collar portion 23 greater in outside diameter than the shaft portion 27. A portion of the collar portion 23 on the forward direction Df side is an outside-diameter-reducing portion 25 whose outside diameter reduces gradually in the forward direction Df. The outside-diameter-reducing portion 25 is supported by the inside-diameter-reducing portion 11 of the insulator 10. The shaft portion 27 is connected to the forward direction Df side of the outside-diameter-reducing portion 25. The first tip 29 is joined to an end of the shaft portion 27 on the forward direction Df side.

The rod portion 28 has an outer layer 21 and a core 22 disposed on the inner-circumference side of the outer layer 21. The outer layer 21 is formed of a material (e.g., an alloy which contains nickel as a main component) superior in oxidation resistance to the core 22. The main component means a component having the highest content (weight % (wt. %)). The core 22 is formed of a material (e.g., pure copper, or an alloy which contains copper as a main component) higher in thermal conductivity than the outer layer 21. The first tip 29 is joined to the outer layer 21 of the rod portion 28. The first tip 29 is formed by use of a material (e.g., a noble metal such as iridium (Ir) or platinum (Pt)) superior in discharge resistance to the shaft portion 27. A portion of the center electrode 20 on the forward direction Df side including the first tip 29 protrudes in the forward direction Df from the axial hole 12 of the insulator 10. Notably, the first tip 29 may be eliminated. The core 22 may also be eliminated.

The metal terminal member 40 is a rodlike member extending along the axial line CL. The metal terminal member 40 is formed by use of an electrically conductive material (e.g., a metal which contains iron as a main component). A rodlike portion 41 of the metal terminal member 40 on the forward direction Df side is inserted into a portion of the axial hole 12 of the insulator 10 on the rearward direction Dfr side.

The resistor element 73 in the through hole 12 of the insulator 10 is a member for suppressing electrical noise. The resistor element 73 is formed by use of, for example, a mixture of glass, an electrically conductive material (e.g., carbon particles), and ceramic particles. The seals 72 and 74 are formed by use of a mixture of an electrically conductive material (e.g., metal particles such as copper particles or iron particles) and glass. The center electrode 20 is electrically connected to the metal terminal member 40 through the first seal 72, the resistor element 73, and the second seal 74. The first seal 72 is in contact with the center electrode 20 and an inner circumferential surface 12*i* of the insulator 10.

The members 72, 73, and 74 within the through hole 12 of the insulator 10 are manufactured, for example, as follows. The center electrode 20, material powder for the first seal 72, material powder for the resistor element 73, and material powder for the second seal 74 are inserted or charged into the through hole 12 of the insulator 10 in this order from an opening of the through hole 12 on the rearward direction Dfr side. The insulator 10 is heated to a temperature higher than the softening points of glass materials for the members 72, 73, and 74. In this state, the metal terminal member 40 is inserted into the through hole 12 from the rearward direction Dfr side. As a result, the materials of the members 72, 73, and 74 are compressed, thereby forming the members 72, 73, and 74.

The metallic shell 50 is a tubular member having a through hole 59 extending along the axial line CL. The insulator 10 is inserted into the through hole 59 of the metallic shell 50, and the metallic shell 50 is fixed to the outer circumference of the insulator 10. The metallic shell 50 is formed by use of an electrically conductive material (e.g., a metal such as carbon steel containing iron as a main component). A portion of the insulator 10 on the forward direction Df side protrudes outward from the through hole 59. Also, a portion of the insulator 10 on the rearward direction Dfr side protrudes outward from the through hole 59.

The metallic shell 50 has a tool engagement portion 51, an outward protruding portion 54, and a forward-end-side trunk portion 52. The tool engagement portion 51 allows an ignition plug wrench (not shown) to be fitted thereto. The outward protruding portion 54 is a flange-like portion disposed on the forward direction Df side of the tool engagement portion 51 and protruding radially outward. A surface 54*f* of the outward protruding portion 54 on the forward direction Df side is a seating surface (also called a metallic-shell seating surface 54*f* or merely called a seating surface 54*f*) and provides a seal in cooperation with a hole formation portion (e.g., a portion of the engine head) which is a portion of an internal combustion engine and has an attachment hole. The forward-end-side trunk portion 52 is connected to the forward direction Df side of the outward protruding portion 54 and includes the forward end surface 55 of the metallic shell 50. The forward-end-side trunk portion 52 has a screw portion 57 formed externally on an outer circumferential surface thereof and adapted to be threadingly engaged with an unillustrated attachment hole of the internal combustion engine (also called an external thread portion 57). The axial line CL is a center axis of the external thread of the screw portion 57. The external thread of the screw portion 57 extends in the direction of the axial line CL.

An annular gasket 80 is disposed between the seating surface 54*f* of the outward protruding portion 54 and the screw portion 57 of the forward-end-side trunk portion 52. The gasket 80 is attached to the metallic shell 50 and is in contact with the seating surface 54*f* When the ignition plug 100 is mounted to the engine head, the gasket 80 is crushed to deform. As a result of the deformation of the gasket 80, a gap between the ignition plug 100 and the engine head is sealed. The gasket 80 is formed of, for example, a metal such as iron.

The forward-end-side trunk portion 52 of the metallic shell 50 has an inward protruding portion 56 located on an inner-circumference side thereof and protruding radially inward. A surface 56*r* (also called a rear surface 56*r*) of the inward protruding portion 56 on the rearward direction Dfr side reduces in inside diameter gradually in the forward direction Df. A forward-end-side packing 8 is held between the rear surface 56*r* of the inward protruding portion 56 and the outside-diameter-reducing portion 16 of the insulator 10. The inward protruding portion 56 indirectly supports the step portion 16 of the insulator 10 via the packing 8. Hereinafter, the inward protruding portion 56 may also be called a support portion 56.

The metallic shell 50 has a rear end portion 53 formed on the rear side of the tool engagement portion 51, as the rear end thereof, and smaller in wall thickness than the tool engagement portion 51. The metallic shell 50 also has a connection portion 58 formed between the outward protruding portion 54 and the tool engagement portion 51 for connecting the outward protruding portion 54 and the tool engagement portion 51. The connection portion 58 is smaller in wall thickness than the outward protruding portion 54 and the tool engagement portion 51. Annular ring members 61 and 62 are inserted between an inner circumferential surface of the metallic shell 50 extending from the tool engagement portion 51 to the rear end portion 53 and an outer circumferential surface of a portion of the insulator 10 on the rearward direction Dfr side of the outside-diameter-reducing portion 18. Further, powder of talc 70 is charged between these ring members 61 and 62. In the manufacturing process of the ignition plug 100, when the rear end portion 53 is bent radially inward for crimping, the connection portion 58 is deformed; as a result, the metallic shell 50 and the insulator 10 are fixed together. In this crimping step, the talc 70 is compressed, thereby enhancing airtightness between the metallic shell 50 and the insulator 10. The packing 8 is pressed between the outside-diameter-reducing portion 16 of the insulator 10 and the inward protruding portion 56 of the metallic shell 50, thereby providing a seal between the metallic shell 50 and the insulator 10. In this manner, the insulator 10 is held between the inward protruding portion 56 of the metallic shell 50 and the rear end portion 53 of the metallic shell 50.

The ground electrode 30 is a metal member and has a rodlike body portion 37. An end portion 33 (also called a proximal end portion 33) of the body portion 37 is joined (e.g., by resistance welding) to the forward end surface 55 of the metallic shell 50. The body portion 37 extends in the forward-end direction Df from the proximal end portion 33 joined to the metallic shell 50, is bent toward the center axis CL, extends in a direction intersecting with the axial line CL, and reaches a distal end portion 34. A surface of the distal end portion 34 on the rearward direction Dfr side and the first tip 29 of the center electrode 20 form a discharge gap g therebetween.

The body portion 37 has an outer layer 31 and an inner layer 32 disposed on the inner-circumference side of the outer layer 31. The outer layer 31 is formed of a material (e.g., an alloy which contains nickel as a main component)

superior to the inner layer 32 in oxidization resistance. The inner layer 32 is formed of a material (e.g., pure copper, or an alloy which contains copper as a main component) higher in thermal conductivity than the outer layer 31. Notably, a second tip similar to the first tip 29 of the center electrode 20 may be fixed to a surface of the distal end portion 34 of the ground electrode 30, which surface is located on the rearward direction Dfr side. The first tip and the second tip may form the discharge gap g therebetween. The inner layer 32 may be eliminated.

B. Evaluation Test

FIG. 2A is a first table TA showing the relation between test results and material features of samples of the ignition plug 100. The first table TA shows, for each of sample types, a sample No, the content of potassium (K), the content of sodium (Na), the evaluation result for withstand voltage, and the evaluation result for densification (degree of sintering). In the evaluation test, six types of samples, namely, sample No. 1 to sample No. 6, were tested. The first seal 72 of each sample contains glass, and brass as an electrically conductive substance. As described with reference to FIG. 1, the first seal 72 is in contact with the center electrode 20. The center electrode 20 increases in temperature as a result of reception of heat from combustion gas. Therefore, preferably, the glass contained in the first seal 72 has good heat resistance. In the samples tested by the present evaluation test, borosilicate glass having good heat resistance was used. As will be described later, the glass employed by the samples has high Si content for improving heat resistance. As a result, the glass is hard. In order to improve adhesion between the first seal 72 and other members (e.g., the center electrode 20 and the insulator 10), preferably, the glass contains a component that lowers the softening point of the glass. For example, alkali metals may lower the softening point of the glass. The glass employed in the samples tested by the present evaluation test contains Na and K. The material for the first seal 72 used in manufacture of the samples contains the material of borosilicate glass. The material of borosilicate glass contains an oxide of sodium (Na) ($Na_2O$) and an oxide of potassium (K) ($K_2O$).

The first table TA (FIG. 2A) shows potassium (K) content as reduced to $K_2O$ and sodium (Na) content as reduced to $Na_2O$. The six types of samples differ in the Na content of the glass of the first seal 72. Although unillustrated, in the six types of samples, the borosilicate glass contained in the first seals 72 has an Si (silicon) content in the range from 55 mass % to 65 mass % as reduced to $SiO_2$. In the six types of samples, the borosilicate glass contained in the first seals 72 has a B (boron) content in the range from 25 mass % to 35 mass % as reduced to $B_2O_3$. As shown in the first table TA, the six types of samples have the same K (potassium) content, specifically, 2 mass % as reduced to $K_2O$. As shown in the first table TA, the Na (sodium) content as reduced to $Na_2O$ is 0, 0.1, 0.3, 0.4, 0.9, and 1 mass % in this order from sample No. 1. Notably, the Si content, the B content, the K content, and the Na content are those of the glass. These contents are the same as those of the material for the glass. The contents of these components can be specified by analyzing the cross sections of the first seals 72 of the samples. For example, by use of a scanning electron microscope (SEM), an SEM image of a target region on the cross section of the first seal 72 is captured. The target region is, for example, a 1 $mm^2$ square. Magnification is, for example, 200 magnifications. Then, by conducting component analysis on the target region by use of an EPMA (Electron Probe Micro Analyzer), a glass phase is identified, and the contents of components in the glass phase are specified. Notably, the six types of samples have the same structural features (e.g., the shape of the center electrode 20) except for the contents of components in the first seal 72. Notably, the difference among the plurality of types of samples in the results of various tests, which will be described later, is greatly influenced by the difference in K content or Na content and is presumably less influenced by the difference in Si content and the difference in B content.

The first table TA shows evaluation results in a withstand voltage test and evaluation results in a densification test. The withstand voltage test was conducted as follows. Four samples of the same type of the ignition plug 100 were attached to a 4-cylinder direct-injection gasoline engine of 1.6 L displacement with supercharger. The discharge gaps g of the ignition plugs 100 were adjusted for having a discharge voltage of 40 kV or higher. This engine was operated for 100 hours under a condition of wide-open throttle (WOT) (also called actual engine operation). After this actual engine operation, the four ignition plugs 100 were disassembled, and the insulators 10 were examined. The insulators 10 were examined in the following manner.

Figure 3A:
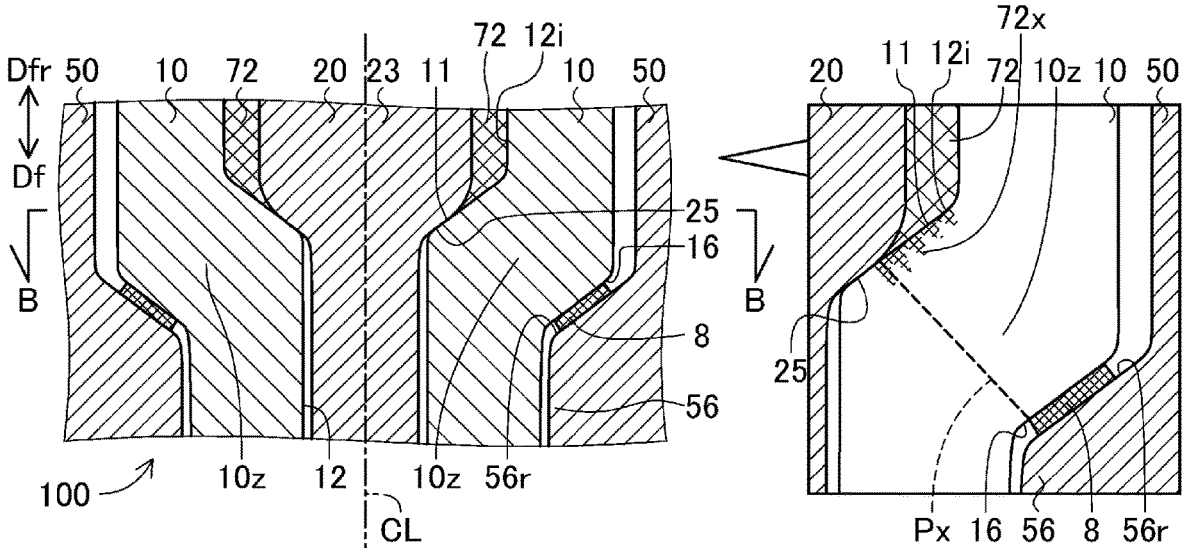
FIG. 3A is a sectional view partially showing the ignition plug and containing a center axis CL of the ignition plug.

FIG. 3A is a portion of the cross section of the ignition plug 100 which contains the center axis CL. FIG. 3A shows a region which encompasses the outside-diameter-reducing portion 25 of the center electrode 20, the inside-diameter-reducing portion 11 and the outside-diameter-reducing portion 16 of the insulator 10, and the inward protruding portion 56 of the metallic shell 50. The inside-diameter-reducing portion 11 of the insulator 10 is in contact with the outside-diameter-reducing portion 25 of the center electrode 20. The outside-diameter-reducing portion 16 of the insulator 10 is supported by the inward protruding portion 56 of the metallic shell 50 through the packing 8. The partial enlarged view at the right of FIG. 3A shows a region which encompasses the inside-diameter-reducing portion 11 and the outside-diameter-reducing portion 16 of the insulator 10. For convenience of description, hatching of the cross section of the insulator 10 is omitted in the partial enlarged view.

High voltage for discharge is applied between the center electrode 20 and the metallic shell 50. Accordingly, high voltage is applied to a portion 10*z* of the insulator 10 between the inside-diameter-reducing portion 11 and the outside-diameter-reducing portion 16 through the center electrode 20, the metallic shell 50, and the packing 8.

The glass in the first seal 72 contains alkali metals (specifically, potassium (K) and sodium (Na)). As mentioned above, since the center electrode 20 increases in temperature as a result of reception of heat from combustion gas, the first seal 72 and a portion of the insulator 10 in the vicinity of the center electrode 20 also increase in temperature. At high temperature, the alkali metals contained in the first seal 72 are apt to move. The alkali metals may diffuse into the insulator 10 from the inner circumferential surface 12*i* of the through hole 12 of the insulator 10. For example, ions of the alkali metals diffuse into the insulator 10. The first seal 72 is in contact with the inside-diameter-reducing portion 11 of the insulator 10. As mentioned above, high voltage is applied to the portion 10*z* of the insulator 10 between the inside-diameter-reducing portion 11 and the outside-diameter-reducing portion 16. As a result, movement of the alkali metals may be accelerated. Notably, a sodium ion is generally smaller in ionic radius than a potassium ion. Accordingly, potassium (K) is unlikely to diffuse into the insulator 10, whereas sodium (Na) is likely to diffuse into the insulator 10.

Figure 3B:
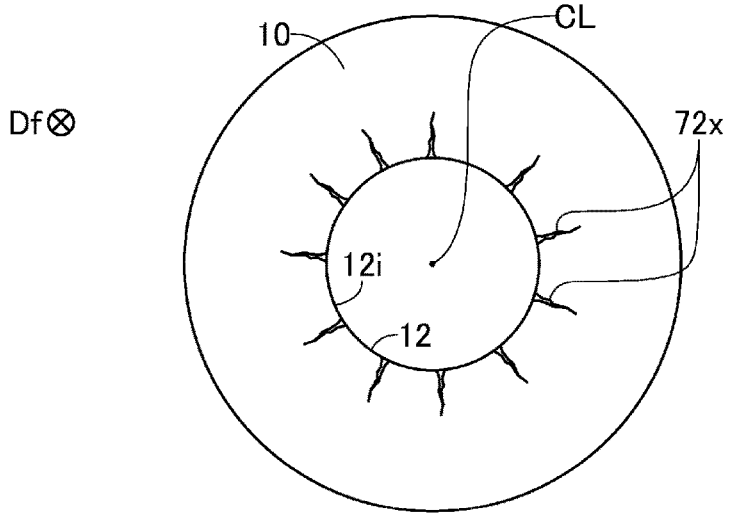
FIG. 3B is a schematic sectional view of an insulator taken perpendicularly to the center axis CL.

The enlarged view at the right of FIG. 3A shows diffusion zones 72*x* where sodium (Na) has diffused. As illustrated, sodium (Na) may diffuse into the insulator 10 in the vicinity of a portion of the inner circumferential surface 12*i* of the insulator 10, which portion is in contact with the outside-diameter-reducing portion 25 of the center electrode 20. FIG. 3B is a schematic view of the cross section of the insulator 10 taken perpendicularly to the axial line CL and is a cross section taken along line B-B of FIG. 3A. The cross section passes that portion of the inside-diameter-reducing portion 11 in contact with the first seal 72 and is located in the vicinity of a portion of the inside-diameter-reducing portion 11 in contact with the center electrode 20. As illustrated, the sodium (Na) diffusion zones 72*x* extend into the insulator 10 from the inner circumferential surface 12*i* of the through hole 12. The diffusion zones 72*x* may be long, narrow zones extending from the inner-circumference side toward the outer-circumference side. In an actual cross section of the insulator 10, zones where sodium (Na) is present change in color to black.

Thus, in the case where the insulator 10 contain sodium (Na) diffused thereinto, discharge may penetrate through the insulator 10 through the medium of sodium (Na). The path Px shown in the enlarged view at the right of FIG. 3A is an example of the path of penetrating discharge. The path Px starts from the inner circumferential surface of the inside-diameter-reducing portion 11 of the insulator 10, passes through the insulator 10, and reaches the outer circumferential surface of the outside-diameter-reducing portion 16 of the insulator 10. The path Px connects the center electrode 20 and the packing 8. In the case where such penetrating discharge has occurred, traces of the path Px (e.g., black points) are observed on the outer circumferential surface of the insulator 10.

In the evaluation test, after the above-mentioned actual engine operation, the samples of the ignition plug 100 were disassembled, and the insulators 10 were taken out. The insulators 10 were cut, and the first seals 72 and other members were removed from the cut insulators 10. There were prepared the cross sections of the insulators 10 described with reference to FIG. 3A and the cross sections of the insulators 10 described with reference to FIG. 3B. The different types of samples are identical in terms of the axial position (the position in the direction parallel to the center axis CL) of the cross section of FIG. 3B in relation to the inside-diameter-reducing portion 11 of the insulator 10. The two types of cross sections of FIGS. 3A and 3B were searched for sodium (Na) by use of an EPMA (Electron Probe Micro Analyzer). The material of the insulator 10 does not contain sodium (Na). Therefore, the detection of sodium (Na) from the cross section of the insulator 10 indicates the diffusion of sodium (Na) into the insulator 10.

The withstand voltage test results in the first table TA (FIG. 2A) indicate the results of evaluation for the state of the four samples examined after the above-mentioned actual engine operation. "A" rating indicates that sodium (Na) was not detected from the cross sections of all of the four insulators 10. "B" rating indicates that sodium (Na) was detected from the cross section(s) of one or more of the four insulators 10 and that traces of penetrating discharge were not detected from all of the four insulators 10. "C" rating indicates that traces of penetrating discharge were detected from one or more of the four insulators 10. Notably, in the case where sodium (Na) was not detected from the cross section of the insulator 10, traces of penetrating discharge were also not detected.

The densification test results indicate whether or not the material for the first seal 72 has sufficiently melted in manufacture of the ignition plug 100. Specifically, one new sample of the ignition plug 100 is cut to prepare the cross section which contains the axial line CL. The cross section of the first seal 72 is observed by use of an optical microscope in order to search particles of the material powder for the glass. As mentioned above, in manufacture of the ignition plug 100, the material powder for the glass contained in the first seal 72 softens within the through hole 12 and is compressed as a result of insertion of the metal terminal member 40. Force from the metal terminal member 40 is difficult to reach a portion of the first seal 72 located away from the metal terminal member 40 (e.g., a portion in the gap between the outside-diameter-reducing portion 25 of the center electrode 20 and the inner circumferential surface 12*i* of the insulator 10). In the case where the material powder of the glass is sufficiently soft in manufacture of the ignition plug 100, particles of the material powder of the glass are not detected from the cross section of the first seal 72 of the completed ignition plug 100. Further, adhesion between the first seal 72 and other members (e.g., the center electrode 20 and the insulator 10) is good. If the material powder of the glass is excessively hard, particles of the material powder of the glass are detected from the cross section of the first seal 72. Further, a gap may be formed between the first seal 72 and other members. In the first table TA (FIG. 2A), "A" rating for densification indicates that particles of the material powder of the glass were not detected. "B" rating indicates that particles of the material powder of the glass were detected.

As shown in the first table TA, the lower the sodium (Na) content, the better the evaluation result for withstand voltage. This is for the following reason: the lower the sodium (Na) content, the less likely the diffusion of sodium (Na) into the insulator 10. Specifically, sample Nos. 1, 2, and 3 rated as A had an Na content of 0, 0.1, and 0.3 mass %, respectively. Sample Nos. 4 and 5 rated as B had an Na content of 0.4 and 0.9 mass %, respectively. Sample No. 6 rated as C had an Na content of 1 mass %.

The higher the sodium (Na) content, the better the evaluation result for densification. This is for the following reason: the higher the sodium (Na) content, the more the softening of glass material in manufacture of the ignition plug 100. Specifically, sample Nos. 2 to 6 rated as A had an Na content of 0.1, 0.3, 0.4, 0.9, and 1 mass %, respectively. Sample No. 1 rated as B had an Na content of 0 mass %.

A preferred range of sodium (Na) content may be determined by use of the sodium (Na) contents of the samples whose evaluation results were good for withstand voltage and densification. For example, sample Nos. 1 to 5 having a sodium (Na) content of less than 1 mass % were rated as B or higher for withstand voltage. Sample Nos. 2 to 6 having a sodium (Na) content of 0.1 mass % or more were rated as A for densification. From these data, a preferred sodium (Na) content may be 0.1 mass % or more and less than 1 mass %.

Sample Nos. 2 to 5, rated as B or higher for withstand voltage and rated as A for densification, had a sodium (Na) content of 0.1, 0.3, 0.4, and 0.9 mass %, respectively. A preferred range of sodium (Na) content may be determined by use of these four values. Specifically, any one of the four values may be employed as the lower limit of the preferred range of sodium (Na) content. For example, sodium (Na) content may be 0.1 mass % or more. Of the four values, any one equal to or greater than the lower limit may be employed as the upper limit of sodium (Na) content. For example, sodium (Na) content may be equal to or less than 0.9 mass %. At a sodium (Na) content that falls within the preferred range, there is restrained penetrating discharge, which would otherwise result from diffusion of sodium (Na), and adhesion between the first seal 72 and other members improves. Of sample Nos. 2 to 5, sample Nos. 2 and 3 were rated as A for withstand voltage. Sample Nos. 2 and 3 had a sodium (Na) content of 0.1 and 0.3 mass %, respectively. A preferred range of sodium (Na) content may be determined by use of these two values. For example, sodium (Na) content may range from 0.1 mass % to 0.3 mass %.

FIG. 2B is a second table TB showing the relation between test results and material features of samples of the ignition plug 100. The second table TB shows, for each of sample types, a sample No, the content of potassium (K) as reduced to $K_2O$, the content of sodium (Na) as reduced to $Na_2O$, and the evaluation results for withstand voltage, densification, and airtightness. Similar to the case of potassium (K) content and sodium (Na) content in the first table Ta, potassium (K) content and sodium (Na) content are of the glass contained in the first seal 72. In the evaluation test, four types of samples, namely, sample No. 7 to sample No. 10, were tested. Sample Nos. 7 to 10 differ from sample Nos. 1 to 6 in FIG. 2A in the following two points. The first difference is that the four types of samples have the same Na content, as reduced to $Na_2O$, of the glass contained in the first seal 72, specifically, 0.2 mass %. The second difference is that the four types of samples differ in K content, as reduced to $K_2O$, of the glass contained in the first seal 72. Specifically, sample Nos. 7 to 10 have a K content of 1, 4, 8, 10 mass %, respectively, as reduced to $K_2O$. Other material and structural features (e.g., the range of Si content and the range of B content of glass contained in the first seal 72 and the shape of the center electrode 20) of sample Nos. 7 to 10 are similar to those of sample Nos. 1 to 6. The methods of testing and evaluating withstand voltage and densification are similar to those described above with reference to FIG. 2A (first table TA).

An airtightness test was conducted as follows. There was prepared a pressure test bed (not shown) equipped with a pressurizing cavity having attachment holes similar to plug attachment holes of an internal combustion engine. The external thread portion 57 of the metallic shell 50 (FIG. 1) was screwed into an internal thread portion of the attachment hole, thereby attaching a sample of the ignition plug 100 to the attachment hole of the pressurizing cavity. The interior of the pressurizing cavity corresponds to a combustion chamber to which the ignition plug 100 attached to the attachment hole is exposed. While air pressure in the pressurizing cavity was increased, the amount of air leakage from the metal terminal member 40 side of the through hole 12 of the insulator 10 was measured. Pressure was set at two stages, specifically, 1.5 MPa and 2.5 MPa. When the pressure was 1.5 MPa, air leakage was not detected from all of the samples. The evaluation results for airtightness shown in the second table TB are evaluation results for air leakage for the case where the pressure was 2.5 MPa. "A" rating indicates that no leakage was detected. "B" rating indicates that leakage at 0.05 ml/min or less was detected. "C" rating indicates that leakage at more than 0.05 ml/min was detected.

As shown in the second table TB, the samples were rated as A for withstand voltage and densification at various potassium (K) contents. In this manner, the samples exhibited good withstand voltage and good densification at various potassium (K) contents. The potassium (K) contents are high as compared with the preferred range of sodium (Na) described above with reference to the first table TA (FIG. 2A). Since potassium (K) can appropriately lower the softening point of the glass, an appropriate first seal 72 can be formed. Also, potassium (K) is less likely to diffuse as compared with sodium (Na). Therefore, even at high potassium (K) content, since the diffusion of potassium (K) is restrained, deterioration in voltage resistance performance is restrained.

At particularly high potassium (K) content, airtightness deteriorated. Presumably, this is for the following reason: at high potassium (K) content, as a result of increase in thermal expansion coefficient of the glass, the first seal 72 is apt to separate from the inner circumferential surface 12*i* of the insulator 10. Specifically, sample Nos. 7 and 8 rated as A had a potassium (K) content of 1 and 4 mass %, respectively. Sample No. 9 rated as B had a K content of 8 mass %. Sample No. 10 rated as C had a K content of 10 mass %.

Sample Nos. 7 to 9, rated as B or higher for airtightness and rated as A for withstand voltage and densification, had a potassium (K) content of 1, 4, and 8 mass %, respectively. A preferred range of potassium (K) content may be determined by use of these three values. Specifically, any one of the three values may be employed as the lower limit of the preferred range of potassium (K) content. For example, potassium (K) content may be 1 mass % or more. Of the three values, any one equal to or greater than the lower limit may be employed as the upper limit of potassium (K) content. For example, potassium (K) content may be equal to or less than 8 mass %. At a potassium (K) content that falls within the preferred range, airtightness between the first seal 72 and other members can be improved. Notably, as shown in the first table TA (FIG. 2A), in the case of fixed potassium (K) content, good withstand voltage and good densification were achieved at various sodium (Na) contents. Therefore, presumably, a preferred range of potassium (K) content can be applied to the case of various sodium (Na) contents falling within the above-mentioned preferred range of sodium (Na) content.

C. Modified Embodiments (1) The first seal 72 may have various material features other than those described above. For example, the glass contained in the first seal 72 may be of other types (e.g., soda-lime glass) in place of borosilicate glass. In any case, usually, the higher the silicon (Si) content of the glass, the lower the thermal expansion coefficient of the glass. Therefore, in order to improve heat resistance of the first seal 72, high silicon (Si) content is preferred. For example, preferably, the silicon (Si) content of the glass is 50 mass % or more as reduced to $SiO_2$. Notably, in the case of excessively high silicon (Si) content, since the softening point of the glass rises, adhesion between the first seal 72 and other members may deteriorate. Therefore, preferably, the silicon (Si) content is restrained. For example, the silicon (Si) content of the glass is preferably 90 mass % or less, more preferably 70 mass % or less, as reduced to $SiO_2$. In the case of use of borosilicate glass, the boron (B) content is not limited to that in the above-mentioned samples, but may assume various other values.

The potassium (K) content of the glass contained in the first seal 72 may be less than 1 mass % as reduced to $K_2O$. The glass contained in the first seal 72 may not contain potassium (K). In either case, by means of the glass contained in the first seal 72 containing sodium (Na) in an amount falling within the above-mentioned preferred range of content, good withstand voltage and good densification can be achieved. The glass contained in the first seal 72 may contain various other components (e.g., $Al_2O_3$).

The electrically conductive substance contained in the first seal 72 is not limited to that of the above-mentioned samples, but may be various metals such as iron and copper.

(2) The members disposed within the through hole 12 of the insulator 10 may have various material features other than those described above. For example, the material for the second seal 74 may differ from the material for the first seal 72. The second seal 74 does not rise in temperature than does the first seal 72. Therefore, in selection of the material for the second seal 74, the requirement for having heat resistance is mitigated. The material for the second seal 74 may be selected from a wider range of materials as compared with the case of selection of the material for the first seal 72.

The intermediate member 79 may have various material features other than those described above. The intermediate member 79 may include the resistor element 73, or the resistor element 73 and another member (e.g., a magnetic member). The intermediate member 79 may include a magnetic member without including the resistor element 73. The intermediate member 79 may be eliminated. In this case, the second seal 74 is also eliminated. The first seal 72 connects the center electrode 20 and the metal terminal member 40.

(3) The ignition plug may have various structures other than that described above. A discharge gap may be formed between the ground electrode and a side surface (a surface located away from the axial line CL in a direction perpendicular to the axial line CL) of the center electrode in place of the forward end surface (e.g., the surface of the first tip 29 on the forward direction Df side in FIG. 1) of the center electrode. The total number of discharge gaps may be two or more. The forward-end-side packing 8 may be eliminated. In this case, a protruding portion (e.g., the inward protruding portion 56 (FIG. 1)) of the metallic shell directly supports the outside-diameter-reducing portion 16 of the insulator 10. The ground electrode 30 may be eliminated. In this case, discharge may be generated between the center electrode of the ignition plug and another member located within a combustion chamber.

The present invention has been described with reference to the above embodiment and modified embodiments. However, the embodiment and modified embodiments are meant to help understand the invention, but are not meant to limit the invention. The present invention may be modified or improved without departing from the gist of the invention and encompasses equivalents of the invention.

What is claimed is:

1. An ignition plug comprising:

an insulator having a through hole extending from a rear-end side toward a forward-end side;

a center electrode inserted at least partially into a portion of the through hole on the forward-end side;

a metal terminal member inserted at least partially into a portion of the through hole on the rear-end side; and a seal disposed within the through hole and in contact with the center electrode and an inner circumferential surface of the insulator, wherein the seal contains a glass and an electrically conductive substance, and the glass contained in the seal contains Si in an amount of 50 mass % or more as reduced to $SiO_2$ and Na in an amount of 0.1 mass % or more and less than 1 mass % as reduced to $Na_2O$.

2. An ignition plug according to claim 1, wherein the glass contains Na in an amount of 0.3 mass % or less as reduced to $Na_2O$.

3. An ignition plug according to claim 2, wherein the glass contains K in an amount of 1 mass % to 8 mass % as reduced to $K_2O$.

4. An ignition plug according to claim 1, wherein the glass contains K in an amount of 1 mass % to 8 mass % as reduced to $K_2O$.

* * * * *